US009771750B2

(12) United States Patent
Held

(10) Patent No.: US 9,771,750 B2
(45) Date of Patent: Sep. 26, 2017

(54) DEVICE FOR OPENING THE CABINET DOOR OF A CABINET BODY

(75) Inventor: Wolfgang Held, Hard (AT)

(73) Assignee: DONGTAI HARDWARE PRECISION (HONG KONG) LIMITED, Tsuen Wan, N.T., Hong Kong (HK)

( * ) Notice: Subject to any disclaimer, the term of this patent is extended or adjusted under 35 U.S.C. 154(b) by 0 days.

(21) Appl. No.: 14/236,632

(22) PCT Filed: Aug. 2, 2012

(86) PCT No.: PCT/EP2012/065164
§ 371 (c)(1),
(2), (4) Date: Apr. 22, 2015

(87) PCT Pub. No.: WO2013/017666
PCT Pub. Date: Feb. 7, 2013

(65) Prior Publication Data

US 2016/0186476 A1 Jun. 30, 2016

(30) Foreign Application Priority Data

Aug. 2, 2011 (DE) ..... 10 2011 052 355

(51) Int. Cl.
*A47B 95/02* (2006.01)
*E05F 13/00* (2006.01)
(Continued)

(52) U.S. Cl.
CPC ..... *E05F 13/00* (2013.01); *E05C 19/165* (2013.01); *E05F 1/105* (2013.01); *E05F 5/02* (2013.01);
(Continued)

(58) Field of Classification Search
CPC .. E05F 13/00; E05F 1/105; E05F 5/02; E05C 19/165; E05Y 2201/212; E05Y 2201/218;
(Continued)

(56) References Cited

U.S. PATENT DOCUMENTS 3,376,088 A * 4/1968 Bol ..... A47B 88/0477 292/353
3,854,785 A * 12/1974 Manner ..... A47B 88/0477 292/DIG. 4
(Continued)

*Primary Examiner* — Daniel J Troy
*Assistant Examiner* — Timothy M Ayres
(74) *Attorney, Agent, or Firm* — John Alumit

(57) ABSTRACT

Device for opening cabinet door of cabinet body. Cabinet door is attached to cabinet body by self-closing hinges. Cabinet door is held in closed position at a small distance from the front of cabinet body. In order to allow cabinet door to be opened without gripping elements, without hindering the self-closing of the hinges, there is a unit having ejection piston with a locking apparatus and tension rod in cabinet body. Ejection piston is supported in the unit by compression spring, and tension rod is supported in the unit by tension spring. Ejection piston and tension rod are coupled to each other by a control apparatus having a freewheel, and thus by tapping on cabinet door the opening of cabinet door can be initiated and cabinet door can be brought into an intermediate position. In the intermediate position, cabinet door can be grasped by a hand and opened further.

11 Claims, 15 Drawing Sheets

(51) Int. Cl.
*E05C 19/16* (2006.01)
*E05F 1/10* (2006.01)
*E05F 5/02* (2006.01)

(52) U.S. Cl.
CPC ... *E05Y 2201/212* (2013.01); *E05Y 2201/218* (2013.01); *E05Y 2201/22* (2013.01); *E05Y 2201/232* (2013.01); *E05Y 2201/246* (2013.01); *E05Y 2800/11* (2013.01); *E05Y 2900/20* (2013.01)

(58) Field of Classification Search
CPC ..... E05Y 2201/22; E05Y 2201/232; E05Y 2201/246; E05Y 2800/11
USPC ..... 312/319.2
See application file for complete search history.

(56) References Cited

U.S. PATENT DOCUMENTS 5,243,735 A * 9/1993 O'Brien, II ..... E05F 3/104 16/49
5,997,056 A * 12/1999 Yamagishi ..... E05C 19/022 292/341.17
6,408,483 B1 * 6/2002 Salice ..... E05F 5/02 16/82
7,152,892 B2 * 12/2006 Rechberg ..... A47G 25/065 292/300
7,201,409 B2 * 4/2007 Adachi ..... E05B 17/0041 292/101
7,207,087 B2 * 4/2007 Salice ..... E05F 5/006 16/374
7,273,240 B2 * 9/2007 Migli ..... A47B 88/0477 292/251.5
7,887,147 B2 * 2/2011 Karg ..... E05F 1/1066 312/319.2
8,109,583 B2 * 2/2012 Bruestle ..... A47B 88/0414 312/319.1
8,282,175 B2 * 10/2012 Herper ..... E05F 1/105 292/DIG. 4
8,376,420 B2 * 2/2013 Peterlunger ..... E05C 19/165 292/251.5
8,840,203 B2 * 9/2014 Bohle ..... A47B 88/0414 312/319.8
2001/0008037 A1 * 7/2001 Brustle ..... A47B 88/047 16/71
2005/0242593 A1 * 11/2005 Migli ..... E05C 19/022 292/220
2007/0180654 A1 * 8/2007 Gasser ..... A47B 88/0414 16/242
2009/0307869 A1 * 12/2009 Salice ..... A47B 88/0477 16/85

* cited by examiner

DEVICE FOR OPENING THE CABINET DOOR OF A CABINET BODY

CROSS-REFERENCE TO RELATED APPLICATION

This application is a national stage application and claims the benefit of the priority filing date in PCT/EP2012/065164 referenced in WIPO Publication WO/2013/017666 filed on Aug. 2, 2012. The earliest priority date claimed is Aug. 2, 2011.

FEDERALLY SPONSORED RESEARCH

Not Applicable

SEQUENCE LISTING OR PROGRAM

Not Applicable

BACKGROUND

The invention relates to a device for opening the cabinet door of a cabinet body as defined by the preamble to claims 1 and 7.

In conventional devices on the market, the cabinet door is mounted on the cabinet body via self-retracting hinges. This type of mounting has the advantage that precisely in the terminal angle of the closing motion of the cabinet door, a secure closure of the cabinet body is effected. The hinges also ensure that in the closed position, the cabinet door assumes a slight spacing x from the front of the cabinet body. However, the disadvantage of this device is that in order to be opened, the cabinet door must be provided with handles, handle fittings, and the like.

It is the object of the invention to develop a device for opening the cabinet door of a cabinet body that makes do without such handle elements, and in which the self-retraction of the hinges between the cabinet door and the cabinet body is unhindered.

This object is attained by means of the features of claim 1.

SUMMARY

A unit comprising an ejection piston, having a compression spring and a locking unit, and a tension rod, having an extension spring, is disposed in the cabinet body. The ejection piston and the tension rod are coupled together via a control device that acts only upon the extension of the tension rod with the cabinet door and displaces the ejection piston out of the cabinet body counter to the tensile force of the extension spring. In the closed position of the cabinet door, the ejection bolt and the tension rod are jacked into the cabinet body, and the locking unit locks the jacked-in position of the ejection piston. When the cabinet door is tapped, the spacing between the cabinet door and the cabinet body is eliminated and the locking unit disengages. After the cabinet door has been tapped, the compression spring of the ejection piston displaces the ejection piston from the cabinet body, whereupon the tension rod is also pulled out of the cabinet body, counter to the tensile force of the tension rod, by a retaining element on the inside of the cabinet door. After this intermediate position has been manually undone, the tension rod is extended farther outward, since the retaining element maintains the connection with the cabinet door, and the ejection piston can be returned into the cabinet body and locked in the retracted position via the locking unit. After the cabinet door is opened farther manually, the tension rod is released and is returned via the extension spring into the retracted outset position. In this way, it becomes possible for the cabinet door, set in the closed position, to open far enough merely by being tapped so that it can be grasped with one's hand and opened farther. When the cabinet door is closed again, the ejection piston and the tension rod are automatically put into their closed positions. The cabinet door therefore does not need to have any handle elements, and the function of the self-retracting hinges is unhindered.

This device can also be used in the same manner for drawers and the like that can be pulled out from a compartment of a cabinet body.

In a further embodiment, the unit can additionally have a damper unit that damps or brakes the impact of the cabinet door on the cabinet body.

The control unit can be embodied as a freewheeling gear wheel, which ensures the coupling of the tension rod with the ejection piston only upon retraction of the tension rod into the cabinet body.

The unit is fastened to the inside of the side wall of the cabinet body that faces away from the hinges of the cabinet door. The face ends of the ejection piston and of the tension rod, in the closed position of the cabinet door, protrude by the spacing from the front of the cabinet body. This spacing x is specified by the self-retracting hinge.

The face end of the tension rod can be provided with a magnetically conductive damping lining.

A further embodiment can be learned from coordinate claim 7 and dependent claims 8-11.

DRAWINGS

The invention will be described in further detail in conjunction with the drawings. In them:

FIG. 1 schematically shows the mounting of the unit in the cabinet body with a retaining element of the cabinet door;

FIG. 2 schematically shows the closed position of the cabinet door on the cabinet body;

FIG. 3 schematically shows the intermediate position of the cabinet door after the cabinet door has been tapped;

FIG. 4 schematically shows the cabinet door being opened farther manually; FIG. 5 shows details of a unit fastened in the cabinet body;

DESCRIPTION

Figure 1:
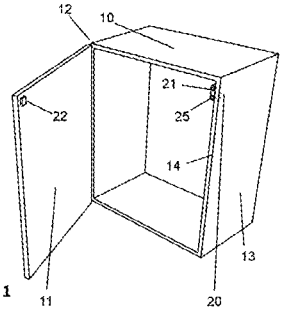

In FIG. 1, a cabinet body 10 is shown, which has a hinged cabinet door 11 on one vertical side at the front. The hinging is done by conventional hinges 12 with self-retraction; that is, the last, small closing angle of the cabinet door 11 is effected in a defined manner by springs of the hinges 12. A unit 20 is fastened opposite the hinges 12 and has an ejection piston 21 and a tension rod 25, which in the outset position protrude from the front of the cabinet body 10 by a spacing x. When the cabinet door 11 is closed, this spacing x is ensured by the self-retracting hinge. The fastening of the unit 20 is done on the inside 14 of the side wall 13.

Figure 2:
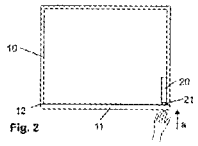
Figure 3:
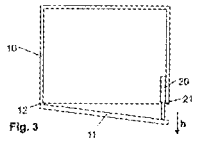
Figure 4:
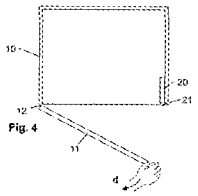

FIG. 2 schematically shows the opening of the cabinet door 11 by tapping it in the direction a; the ejection piston 21 is definitive for the opening motion b of the cabinet door 11. After that, the cabinet door 11 assumes an intermediate position, as shown in FIG. 3. The cabinet door 11 is moved in the direction b by the ejection piston 21. From this intermediate position in FIG. 3, the cabinet door 11 can be opened farther by grasping it with one's hand, whereupon the ejection piston 21 and the tension rod 25 resume their outset position in the cabinet body 10, as shown in FIG. 4. The opening angle is defined by the motion d.

Figure 5:
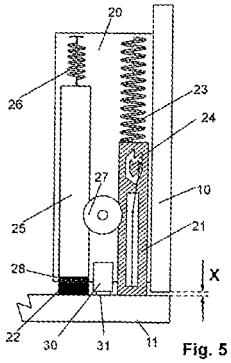

In FIG. 5, one exemplary embodiment of the unit 20 is shown. The unit 20 has an ejection piston 21, which is supported on the unit 20 by a compression spring 23 and has a locking unit 24. At the same time, the unit 20 has a tension rod 25, which is supported in the unit 20 by an extension spring 26. The ejection piston 21 is coupled to the tension rod 25 via a control unit 27 embodied as a freewheeling gear wheel. The control unit 27 is explained in terms of its mode of operation in conjunction with FIGS. 6-9. As FIG. 5 also shows, the unit 20 can have a damper unit 30, which from a cushioned damper 31 damps or brakes the impact of the cabinet door 11 on the front of the cabinet body 10. The cabinet door 11 has a retaining element 22, which is oriented toward the face end of the tension rod 25 and can be embodied as a magnet and which carries the tension rod 25 with it until the intermediate position of FIG. 7 is established. The face end of the tension rod 25 can be provided with a magnetically conductive damping lining 28.

Figure 6:
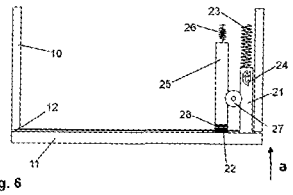
FIG. 6 shows the elements of the unit in the closed position of the cabinet door.
Figure 7:
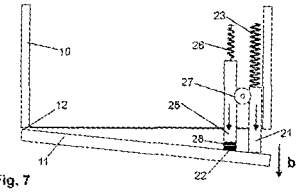
FIG. 7 shows the elements of the unit in an opened intermediate position.

FIG. 6 shows the outset closed position of the unit 20. The ejection piston 21 is subject to the tensing force of the compression spring 23 and the cooperating locking unit 24. The tension rod 25 too is retracted by the extension spring 26 correspondingly far into the cabinet body 10. The cabinet door 11 is additionally retained by the retaining element 22 on the tension rod 25. As the motion arrow a indicates, this outset position of the cabinet door 11 can be tripped and opened by tapping on the cabinet door 11 at a. In the process, the locking unit 24 is disengaged, so that the compression spring 23 can move the ejection piston 21 out of the cabinet body 10. The extension spring 26 of the tension rod 25 can follow along with this extension motion, since the retaining element 22 maintains the connection with the cabinet door 11, as FIG. 7 shows.

Figure 8:
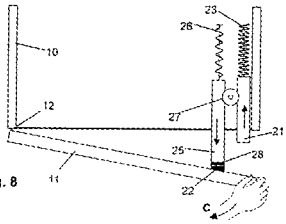
FIG. 8 shows the elements when the cabinet door in the intermediate position is being grasped, with the control unit in action between the tension rod and the ejection piston.

In this intermediate position, the cabinet door 11 can be grasped with one's hand and opened farther, as FIG. 8 shows with the motion c.

In this opening motion c, the tension rod 25 is coupled with the ejection piston 21 via the control unit 27 in such a way that the ejection piston is retracted into its outset position and locked with the locking unit 24. Finally, the tension rod 25 reaches its terminal extension position, and the retaining element 22 releases the connection with the cabinet door 11. The tension rod 25 can be retracted by the extension spring 26 into the cabinet door 10 into the outset position, as can be seen from FIG. 9.

In FIGS. 10-16, a different version of the device is shown, which operates with the same functional steps. This device, which is claimed in its own coordinate claim and dependent claims 8-11, has an ejection element 30 and a tension element 40 with a tension spring 43.

The unit 20 with the housing 60 is fastened to an inner wall, which is opposite the hinges. With an end piece 34 that has retaining elements 35, the ejection element 30 protrudes from the front of the cabinet compartment, in such a way that the housing 60 is flush with the face end of the cabinet body 11.

Figure 10:
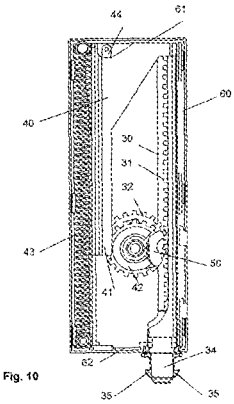
FIG. 10 shows another version of the device, which has an ejection piston, a tension spring and a tension element and is controlled by two gear wheels and a connection element, in the outset position.

FIG. 10 shows the device in the outset position, in which the cabinet door 11 is connected to the end piece 34 and is remote from the face end of the cabinet body 10 by the spacing x. The device has both the ejection element 30, which has a set of teeth 31, and the tension element 40, with which the tension spring 43 is associated. The ejection element 30 and the tension element 40 have sets of teeth 31 and 41, which are oriented counter to one another. The sets of teeth 31 and 41 mesh diagonally with two gear wheels 32 and 42. A connection element 50 is associated with the two gear wheels 32 and 42 and can connect the two gear wheels 32 and 42 to one another in such a way that they rotate in the same direction. If no connection is made between the two gear wheels 32 and 42, then the two gear wheels 32 and 42 are rotatable in arbitrary directions independently of one another. The bearing axes of the gear wheels are offset from one another. The bearing axis of the gear wheel 32 is offset by a small spacing in the direction of the back wall 61 of the housing 60, so that differences when the two gear wheels are rotating in the same direction can be better compensated for.

In the outset position, the tension spring 43 is tensed. The tension element 40 rests against the back wall 61 of the housing 60. A rotatably supported locking element 44 locks the tension element 40 and the tension spring 43.

Figure 11:
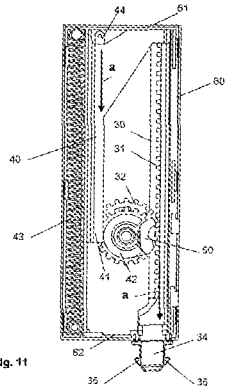
FIG. 11 shows the initiation of the motions when the cabinet door is tapped.
Figure 12:
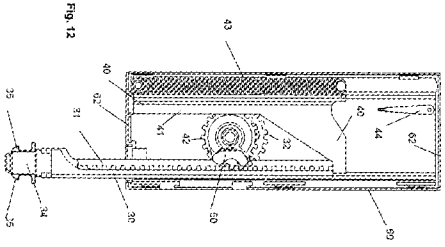
FIG. 12 shows the device in the intermediate position.

When one taps on the cabinet door 11, the end piece 34 of the ejection element 30 is thrust into the unit 20. The locking element 44 will then release the tension spring 43, so that as FIG. 11 shows, both the tension element 40 and the ejection element 30 execute a motion in the direction of the arrow a. The cabinet door 11 is now firmly held in the intermediate position (FIG. 12), and the tension spring 43 is relaxed and the tension element 40 rests on the front wall 62 of the housing 50. Upon this displacement, the two gear wheels 32 and 42 are connected to one another via the connection element 50.

Figure 13:
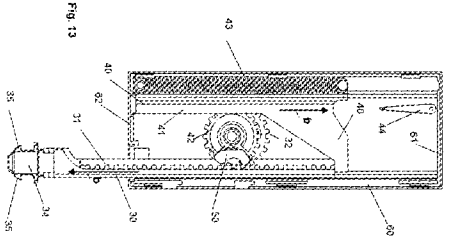
FIG. 13 shows the device upon further manual extension past the intermediate position.
Figure 14:
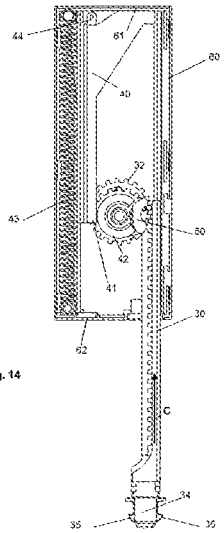
FIG. 14 shows the device after the cabinet door is let go.
Figure 15:
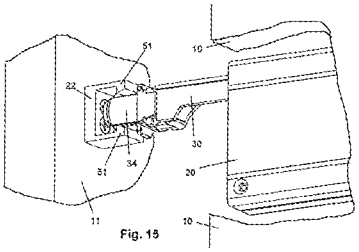
FIG. 15 shows the latching of the ejection rod with the retaining element mounted on the cabinet door.
Figure 16:
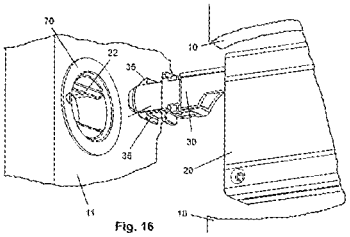
FIG. 16 shows the building in of the retaining element into the inside of the cabinet door.
Figure 17:
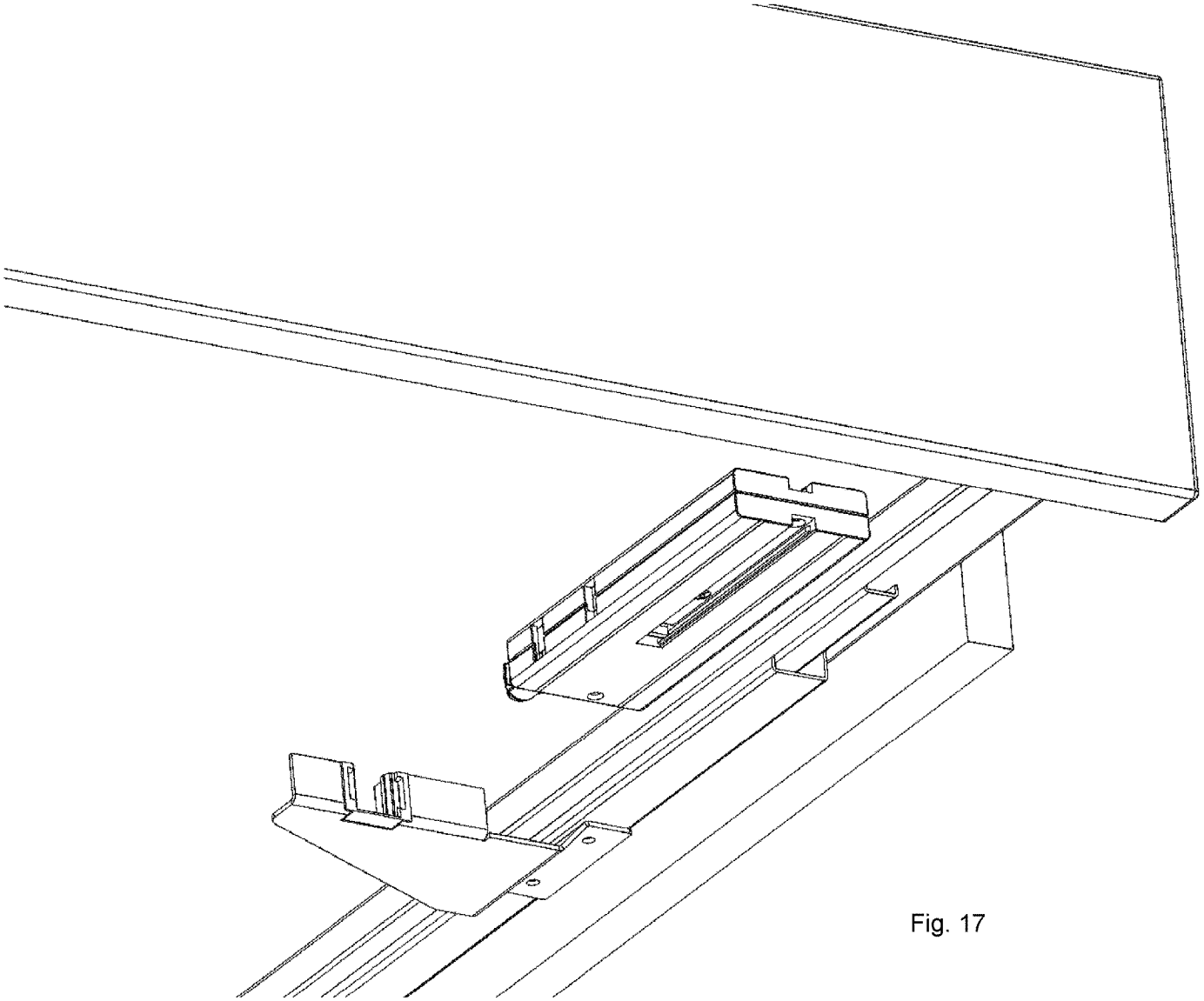
FIGS. 17-20 show the device used in connection with a drawer.
Figure 18:
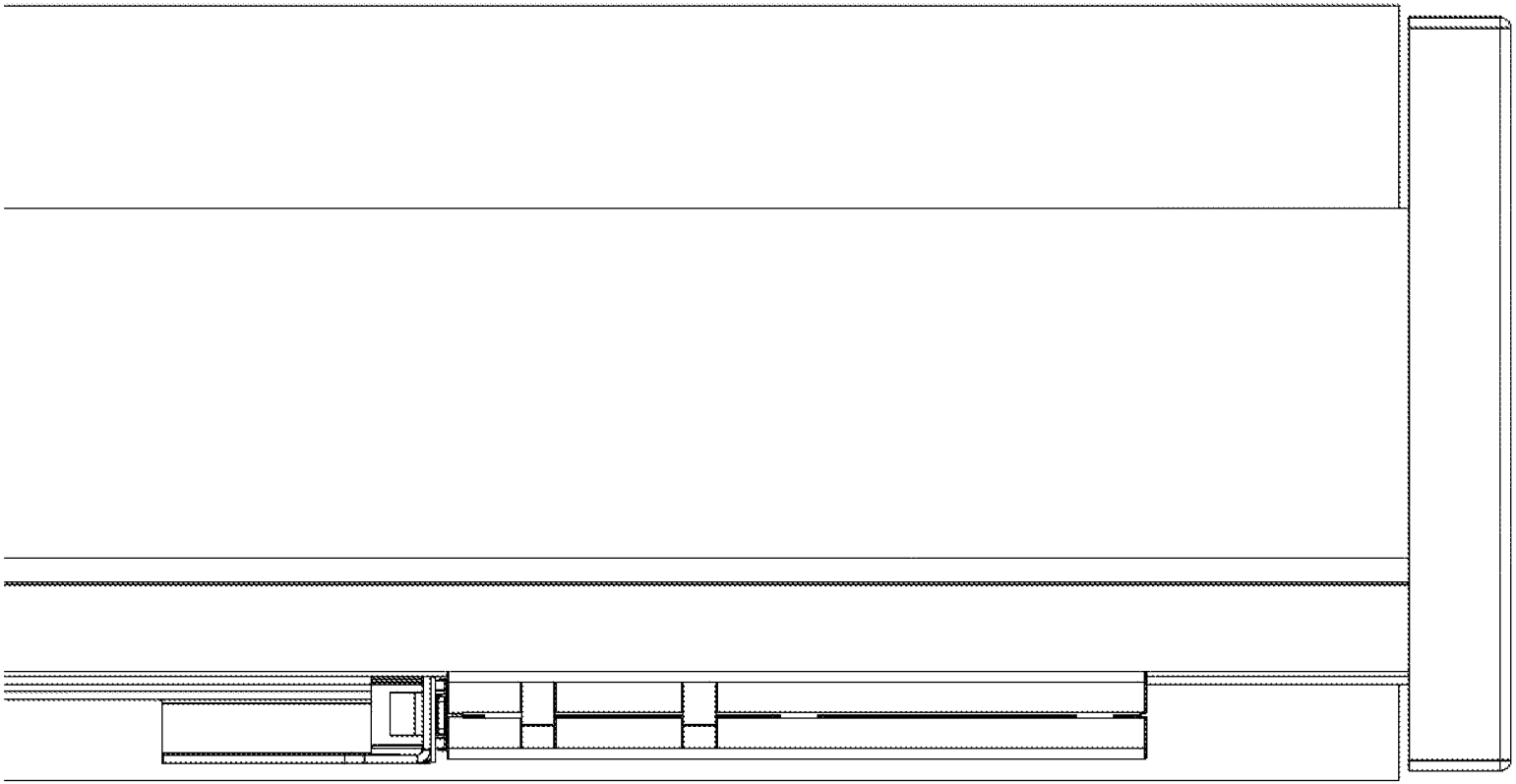
Figure 19:
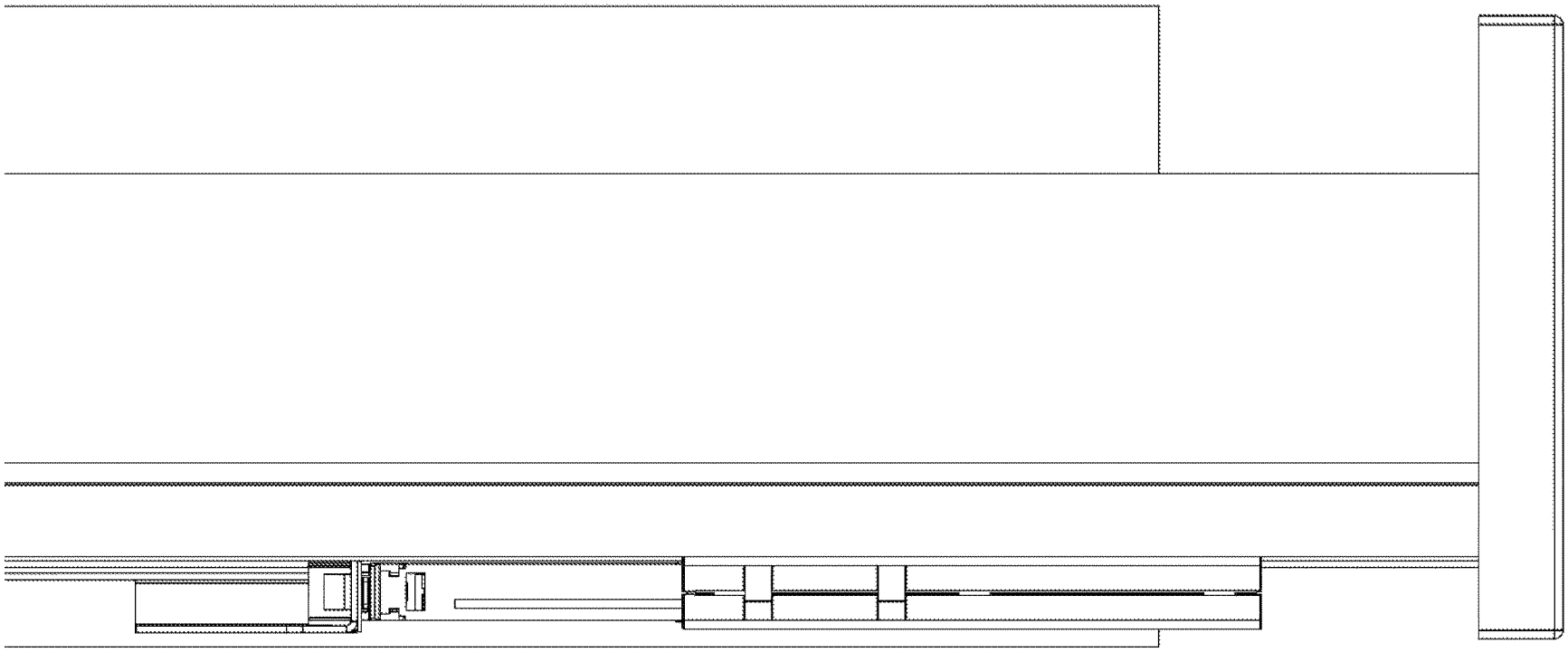
Figure 20:
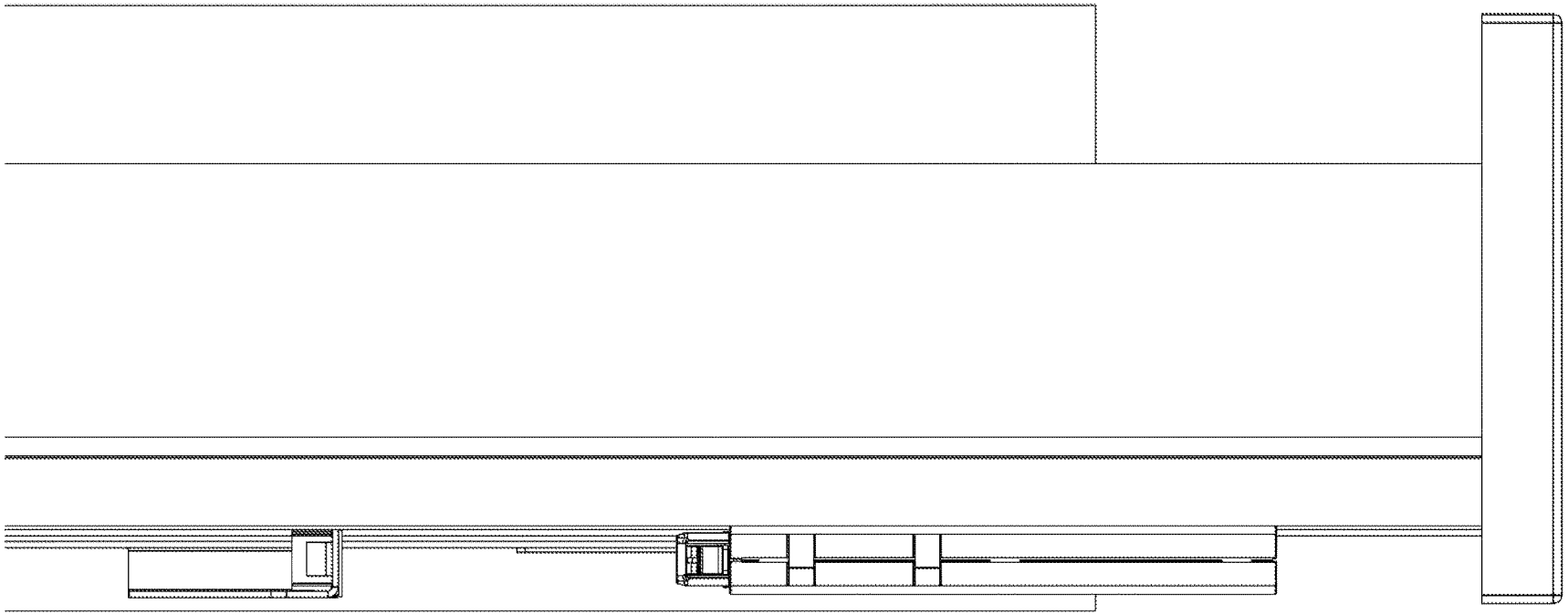

If the cabinet door 11 in the intermediate position (FIG. 12) is grasped manually, then the ejection element 30 also follows along for a short displacement distance, as can be seen from FIG. 13. The gear wheel 32 is rotated, as is the gear wheel 42, both clockwise. This causes tensing of the tension spring 43 and causes it to be locked in the tensing position by the locking element 44. After that, the ejection element 30 releases the cabinet door 11. The ejection element 30 can be brought from this terminal position upon closure of the cabinet door 11 into the outset position, since when the gear wheels 32 and 42 are not connected to one another, the tension element 40 and the tension spring 43 are unaffected. Only once the final displacement distance defined by the spacing x is brought about by tapping on the cabinet door 11 is the tension spring 43 unlocked and can then be relaxed. The device has then returned to the outset position of FIG. 10.

A special feature here is also the connection between the cabinet door 11 and the end piece 34 of the ejection element 30. This end piece on the end of the ejection element 30 has detent elements 35, which latch with counterpart detent elements 51 of the retaining element 22. The retaining element 22 is preferably secured in a round receptacle 70 on the inside of the cabinet door 11. The terminal position of the extension motion of the ejection element 30 is determined by impacts of the ejection element 30 on the front wall 61 of the housing 60. The end piece 34 is still displaceable out of this position of the ejection element 30 to a limited extent; this displacement is determined by impacts on the end piece 34 and the ejection element 30. With this displacement, the detent elements 35 can also be pivoted, so that the latching is undone and the cabinet door 11 can be fully opened. The detent elements 35 latch to the counterpart detent elements 51 of the retaining element 22 whenever the end piece 34 is introduced back into the retaining element 22.

Figure 9:
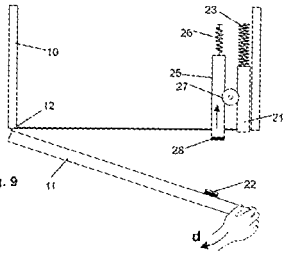
FIG. 9 shows the elements of the unit as the cabinet door is opened still farther manually (motion d)

What is claimed:

1. A device for opening a cabinet door (11) of a cabinet body (10), in which the cabinet door (11) is mounted on the cabinet body (10) by means of self-retracting hinges (12), and in a closed position the cabinet door (11) is kept at a spacing (x) from the front of the cabinet body (10), Wherein a unit (20) comprising an ejection piston (21) and a tension rod (25), the ejection piston having a compression spring (23) and a locking unit (24), and the tension rod having an extension spring (26), is disposed in the cabinet body (10);

the ejection piston (21) and the tension rod (25) are coupled together via a control device (27) which acts only upon retraction of the ejection piston (21) into the cabinet body (10) and displaces the tension rod (25) out of the cabinet body (10) counter to the tensile force of the extension spring (26);

in the closed position of the cabinet door (11), the ejection piston (21) and the tension rod (25) are stored in the cabinet body (10), and the locking unit (24) locks the stored position of the ejection piston (21);

when the cabinet door (11) is pressed (a), the spacing (x) between the cabinet door (11) and the cabinet body (10) is eliminated and the locking unit (24) can be disengaged;

after the cabinet door (11) has been pressed (a), the compression spring (23) of the ejection piston (21) is displaced out of the cabinet body (10), whereupon the tension rod (25) is also displaced out of the cabinet body (10) counter to the tensile force of the extension spring (26) by a retaining element (22) on the inside of the cabinet door (11;

after the intermediate position has been achieved by further opening the cabinet door (FIGS. 8, 9), the tension rod (25) is extensible farther outward, since the retaining element (22) maintains the connection with the cabinet door (11), and the ejection piston (21) can be returned into the cabinet body (10) and locked via the control unit (27); and after further manual opening of the cabinet door (11), the tension rod (25) is released and is returned via the extension spring (26) into the retracted outset position (FIG. 9).

2. The device of claim 1, wherein the device for opening a cabinet door can be used for drawers that can be pulled out from a compartment of a cabinet body.

3. The device of claim 1, wherein the unit (20) additionally has a damper unit (30), which damps or brakes the impact of the cabinet door (11) on the cabinet body (10).

4. The device of claim 1, wherein the control unit (27) is embodied as a freewheeling gear wheel, which ensures coupling of the tension rod (25) with the ejection piston (21) only upon retraction of the tension rod (25) into the cabinet body (10).

5. The device of claim 1, wherein the unit (20) is fastened to the inside (14) of the side wall (13) of the cabinet body (10) that faces away from the hinges (12) of the cabinet door (11); and the face ends of the ejection piston (21) and of the tension rod (25), in the closed position of the cabinet door (11), protrude by the spacing (x) from the front of the cabinet body (10).

6. The device of claim 5, wherein the face end of the tension rod (25) is provided with a magnetically conductive damping lining (28).

7. A device for opening the cabinet door (11) of a cabinet body (10), in which the cabinet door (1) is mounted on the cabinet body (10) by means of self-retracting hinges (12), and in the closed position the cabinet door (11) is kept at a spacing (x) from the front of the cabinet body (10), wherein a unit (20) comprising an ejection element (30) having tooth spacing (31), a tension element (40) with tooth spacing (41), and a tension spring (43) are disposed in the cabinet body (10);

the tooth spacings (31, 41) of the ejection element (30) and of the tension element (40) mesh with separate gear wheels (32, 42);

the two gear wheels (32, 42) are connectable to one another via a connecting element (50) that acts only when the ejection element (30) is pulled out, whereupon the sets of teeth (31, 41) of the ejection element (30) and of the tension element (40) mesh diametrically with the separate gear wheels (32, 42);

the connection of the two gear wheels (32, 42) is effected via a connecting element (40), which only when the ejection element (30) is pulled out undoes the connection of the two gear wheels (32, 42) , whereupon the tension spring (43) returns to the outset position and the ejection element (30) reaches an intermediate position;

thereupon this outward motion of the ejection element (30) can be initiated by pressing on the cabinet door (11), whereupon in the intermediate position the ejection element (30) is still kept on the cabinet door (11);

as the cabinet door (11) is opened farther manually, the ejection element (30) can be briefly entrained with it, whereupon the connection element (50) connects the two gear wheels (32, 42) and initiates the tensing and locking of the tension element (40);

when the final extension position of the ejection element (30) is reached, the cabinet door (11) can be released; and upon closure of the cabinet door (11), the ejection element (30) can be pushed into the cabinet compartment and thus into the unit (20).

8. The device of claim 7, wherein the tensed position of the tension spring (43) is limited by the impact of the tension element (40) on the back wall (61) of the housing (60) of the unit (20); and the outset position of the tension spring (43) is determined by the impact of the tension element (40) on the front wall (62) of the housing (60) of the unit (20).

9. The device of claim 7, wherein the ejection element (30), at its tip, has an end piece (34) with detent elements (35);

the detent elements (35) of the end piece (34), when the cabinet door (11) is in contact with them, latch to counterpart detent elements (51) of the retaining element (22) fastened to the inside of the cabinet door (11); and this detent connection can be released when the end piece (34) of the ejection element (30) has been put, past the intermediate position, into its own terminal position.

10. The device of claim 9, wherein the end piece (34) is displaceable via a separate adjusting rod in the ejection element (30), and the terminal position of the end piece (34) is determined by impacts of the ejection element (30).

11. The device of claim 7, wherein the two gear wheels (32, 42) are supported via their own bearing axes; and the bearing axis of the gear wheel (32) meshing with the ejection element (30) is offset in the direction of the back wall (61) of the housing (60) of the unit (20).

* * * * *